US007628299B2

(12) United States Patent
Johnson

(10) Patent No.: US 7,628,299 B2
(45) Date of Patent: Dec. 8, 2009

(54) THREADED SPOUT

(75) Inventor: James Johnson, Delaware, OH (US)

(73) Assignee: Liqui-Box Corporation, Worthington, OH (US)

( * ) Notice: Subject to any disclaimer, the term of this patent is extended or adjusted under 35 U.S.C. 154(b) by 487 days.

(21) Appl. No.: 11/051,073

(22) Filed: Feb. 3, 2005

(65) Prior Publication Data

US 2005/0184105 A1 Aug. 25, 2005

Related U.S. Application Data

(60) Provisional application No. 60/541,702, filed on Feb. 3, 2004.

(51) Int. Cl.
*B65D 5/72* (2006.01)

(52) U.S. Cl. ..... 222/568; 222/92; 222/95; 222/569; 141/346

(58) Field of Classification Search ..... 222/566–570, 222/92, 95, 519, 522; 285/139.3, 141.1, 285/390–391; 141/346, 348–349; 251/149.6
See application file for complete search history.

(56) References Cited

U.S. PATENT DOCUMENTS 3,168,969 A * 2/1965 Krieps ..... 222/520
4,129,236 A * 12/1978 Wrycraft et al. ..... 222/570
4,286,636 A 9/1981 Credle
4,445,539 A * 5/1984 Credle ..... 137/614.03
5,255,713 A * 10/1993 Scholle et al. ..... 137/614.04
5,445,186 A * 8/1995 Richter et al. ..... 137/614.2
5,983,964 A * 11/1999 Zielinksi et al. ..... 141/346
6,347,785 B1 2/2002 Copp et al.
6,612,545 B1 * 9/2003 Rutter et al. ..... 251/149.6
6,637,725 B2 10/2003 Davis et al.
6,702,337 B2 * 3/2004 Rutter et al. ..... 285/377
2004/0232374 A1 * 11/2004 Rutter et al. ..... 251/149.6
2004/0256424 A1 12/2004 Johnson

FOREIGN PATENT DOCUMENTS

CA 2462500 A1 5/2003
EP 0502716 A2 9/1992

OTHER PUBLICATIONS

Copending U.S. Appl. No. 10/076,572.

* cited by examiner

*Primary Examiner*—Frederick C. Nicolas

(57) ABSTRACT

The present invention provides a spout for use with a container for holding and dispensing a fluid. The spout comprises a generally cylindrical body having an external surface capable of mating with a collar of a dispensing connector. The external surface has at least one threaded portion that is capable of mating with the internal surface of a collar of a dispensing connector.

3 Claims, 5 Drawing Sheets

THREADED SPOUT

PRIORITY

This application claims the benefit of U.S. Provisional Application No. 60/541,702 filed Feb. 3, 2004, which is incorporated by reference herein in its entirety.

FIELD OF THE INVENTION

The present invention provides a spout for use with a collapsible bag for the dispensing of liquids and semi-liquids from the bag. More particularly the present invention relates to a threaded spout for use on a collapsible bag for dispensing of liquids and semi-liquids from the bag.

BACKGROUND OF THE INVENTION

Many systems are used for dispensing beverage syrup from a disposable package consisting of a flexible collapsible bag in a corrugated box commonly referred to as a bag-in-box dispensing package.

Generally these systems include a bag that is provided with a fitment in the form of a spout through which filling and dispensing occurs. It is generally desirable to provide a quick-disconnect coupling between the spout and the service line of the pump or other type of beverage mixing and dispensing system. Such a coupling may be carried on the spout fitment of the bag and will work in conjunction with the service line connector, and is commonly called in the art a single-service valve and coupling since it is discarded with the bag when it is emptied. This type of valve opens automatically as the line connector is connected to the spout and closes as it is disconnected therefrom to prevent syrup from draining from the bag. An example of a single-service valve is illustrated in U.S. Pat. No. 4,286,636, which shows it in combination with a dip tube.

Some systems have recently been developed that are adapted to be used with various types of service line connectors. An example of such a system is illustrated in U.S. Pat. No. 6,347,785 which discloses a universal quick-disconnect coupling and valve. The fitment disclosed is adapted to be attached to a container for holding a liquid and includes a generally cylindrical spout that is capable of mating with a dispensing connector. A slider moves axially within the spout, and has a valve mounted within it that moves from a closed position to an open position upon insertion of a dispensing connector into the slider.

The various types of service line connectors include a variety of attachment mechanisms for connecting to a spout on the container holding the liquid. Therefore it is generally required that the spouts provided on the containers are able to connect to the different attachment mechanisms. The various connecting mechanisms can lead to problems with the connection between the container and the service line. For example, cross threading may occur if the spout is not attached correctly to the service line connector, which may lead to problems with leakage of the liquid at the connection point. This is exacerbated by the fact that the material used to make these parts is deformable and hence can be easily damaged when force is applied during threading of the spout onto the connector.

It is important to recognize that the spouts and bags are one-time use products, which need to be properly installed in order to avoid spillage and leakage. These spouts and bags are generally used in typical high volume applications, such as restaurants, in which the bags can be changed up to 3 or more times a day by people of varying levels of familiarity with the equipment. Thus any improvement that ensures an easy, rapid, accurate and tight fitting connection is desirable.

SUMMARY OF THE INVENTION

The present invention provides a spout for attachment to a container for holding and dispensing a fluid. The spout comprises a generally cylindrical body having an external surface capable of mating with a collar of a dispensing connector. The external surface includes at least one threaded portion that is capable of mating with the internal surface of the collar of the dispensing connector.

More particularly, the invention provides a threaded spout for use on a collapsible bag for dispensing of liquids and semi-liquids from the bag, the spout comprising a generally hollow cylindrical body having an external surface capable of mating with a collar of a dispensing connector, the external surface includes at least one threaded portion that is adapted to mate with the internal surface of the collar of the dispensing connector, the spout having at one end thereof a base portion for securing the spout to the collapsible bag.

The present invention may be used with a double slider fitment as disclosed in co-pending U.S. provisional No. 60/458,077, now U.S. Patent Publication No. 2004-0256424-A1. It may also be used with other conventional or known fitments.

DESCRIPTION OF THE DRAWINGS

The present invention is better understood with reference to the attached description and to the following Figures, wherein.

DETAILED DESCRIPTION OF THE INVENTION

Figure 1:
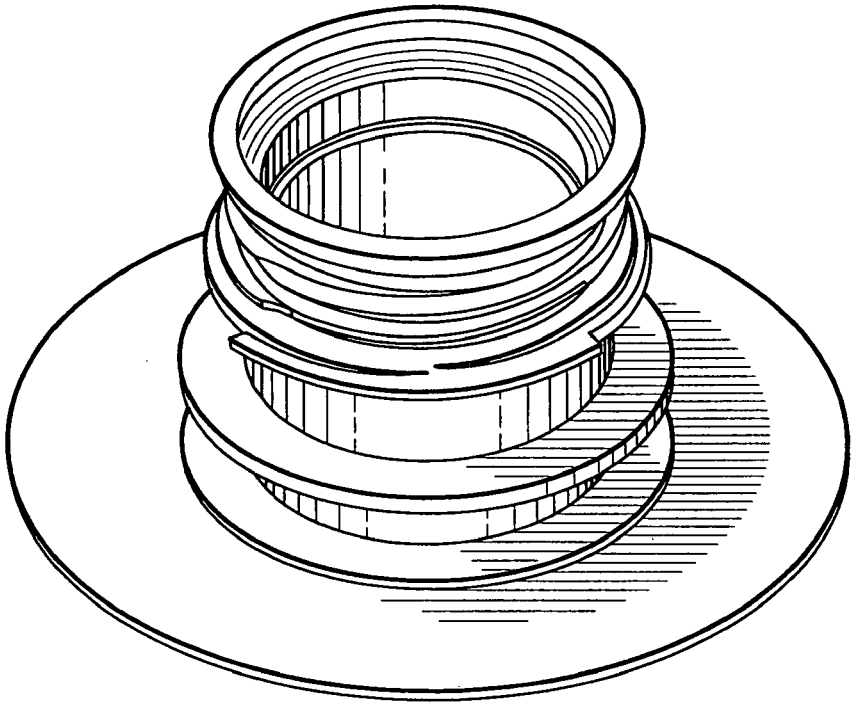
FIG. 1 is a photographic illustration of a front perspective view of an embodiment of the threaded spout of the present invention.

In a liquid dispensing apparatus such as is used to dispense individual servings of beverages and the like, the syrups, flavourings and other ingredients are frequently supplied in collapsible containers enclosed and shipped within an outer container ("bag-in-box"). The shipping package or container is provided with a fitment that accepts a probe that is part of the dispensing apparatus in order to connect the supply of liquid to the dispensing apparatus. The fitment generally contains a valve that is actuated by the insertion of the probe of the dispensing apparatus in order to allow the liquid to flow into the dispensing apparatus. The fitment attached to the liquid container is generally termed a package connector and the probe or similar device on the dispensing apparatus that interacts with the package connector is generally termed a dispensing connector. The fitment includes a spout portion that is attached to the container and has an external surface that connects with an internal surface of the dispensing connector.

The invention will be illustrated by reference to the drawings which illustrate a preferred embodiment thereof.

With reference to FIGS. 1-4, the present invention provides a spout, illustrated generally at 20 for attachment to a container (not shown) for holding a liquid (not shown). The spout 20 comprises a generally cylindrical body 22 having an external surface 24 and an internal surface 26. Located on the external surface 24 is threaded connecting means 28 that is operable to connect with an internal surface of a dispensing connector (not shown).

Each of the components of the threaded spout 20 will now be described with reference to the preferred embodiment of the present invention. As can be seen in FIGS. 1 through 4 the spout 20 has a body 22 that is generally a hollow cylindrical shape and has an external surface 24 capable of mating with a collar of a dispensing connector. At one end of the spout 20 there is a base portion 30 for attaching the spout to a wall of a container, not illustrated. Methods and means for attaching the base portion 30 to a wall of a container are well known in the art and it will be understood that a variety of attachment mechanisms may be used to secure the spout of the present invention to a container wall, such as by welding, heat sealing or adhesive attachment.

Located at the opposing end of the spout 20 from the base portion 30 is the spout opening 32 which is adapted to receive a dispensing connector therein (not shown). As will be understood by a person skilled in the art, the spout 20 may be used as part of a fitment (not shown) that includes a slider (not shown) located within the spout 20. An example of a suitable fitment and slider can be found in, but is not limited to, those described in Applicant's co-pending U.S. Provisional No. 60/458,077 the disclosure of which is herein incorporated by reference in its entirety. The internal surface 26 of the spout 20 may include an integrally molded stop ridge (not shown) and sealing rings (not shown), both of which may serve to limit the motion of the slider at certain stages in the functioning of the coupling and dispensing valve. The stop ridge and sealing rings are further described in U.S. Pat. No. 6,347,785 (Copp et al.) the disclosure of which is herein incorporated by reference in its entirety.

Figure 2B:
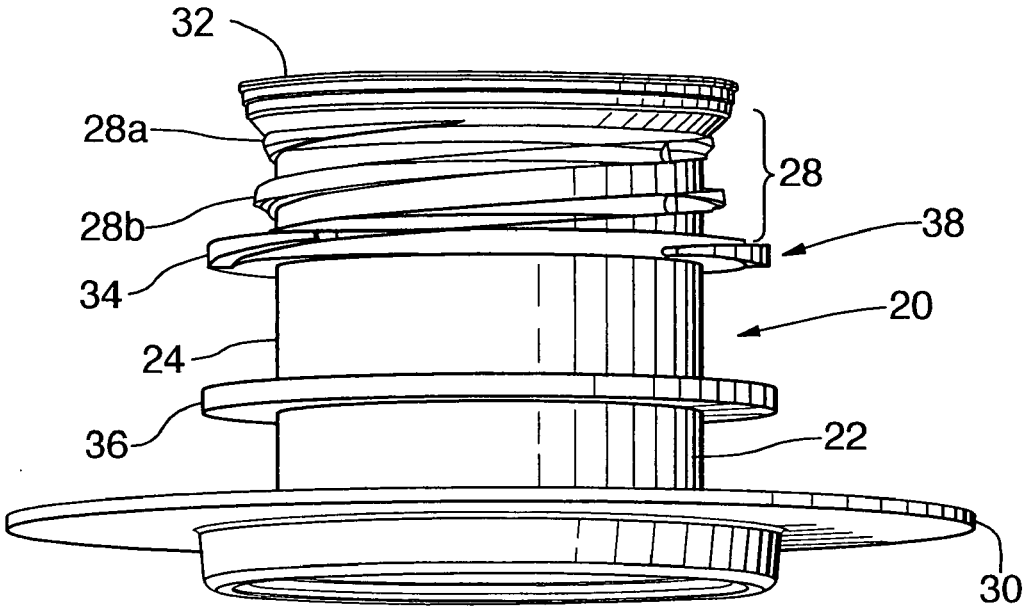
FIG. 2*b* is a photographic illustration of an isometric view of the threaded spout of the invention.
Figure 2A:
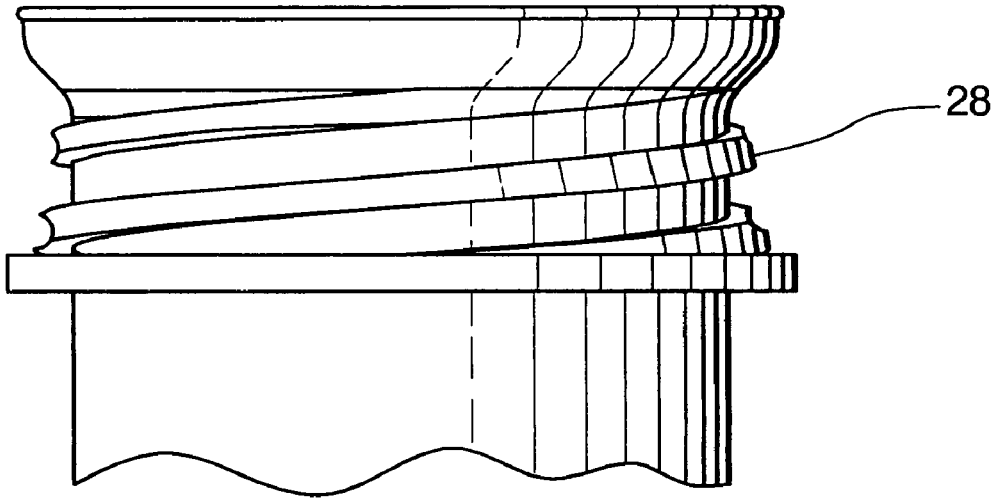
FIG. 2*a* is a portion of the threaded spout of FIG. 2 which illustrates a thread arrangement.
Figure 5:
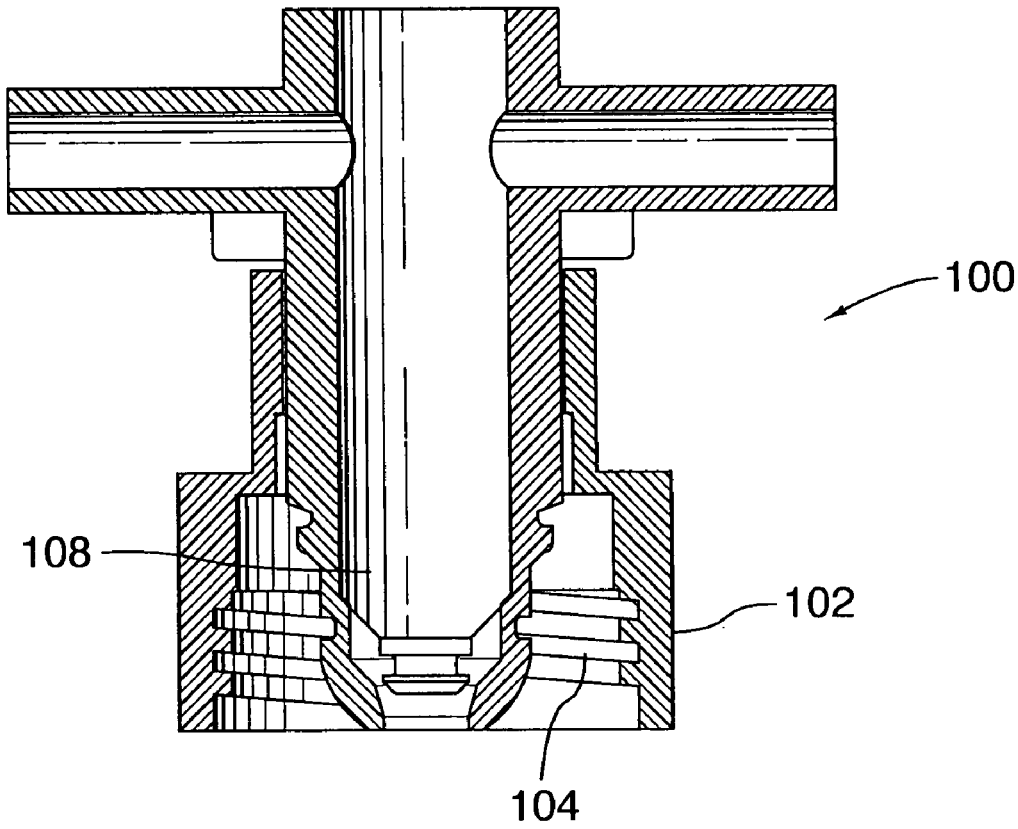
FIG. 5 is a cross-sectional view of the threaded spout of FIG. 1 prior to connection to a dispensing connector.
Figure 5:
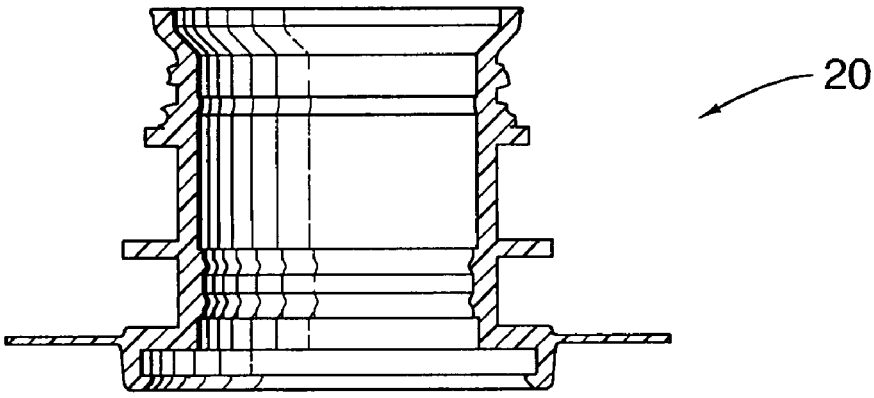
Figure 6:
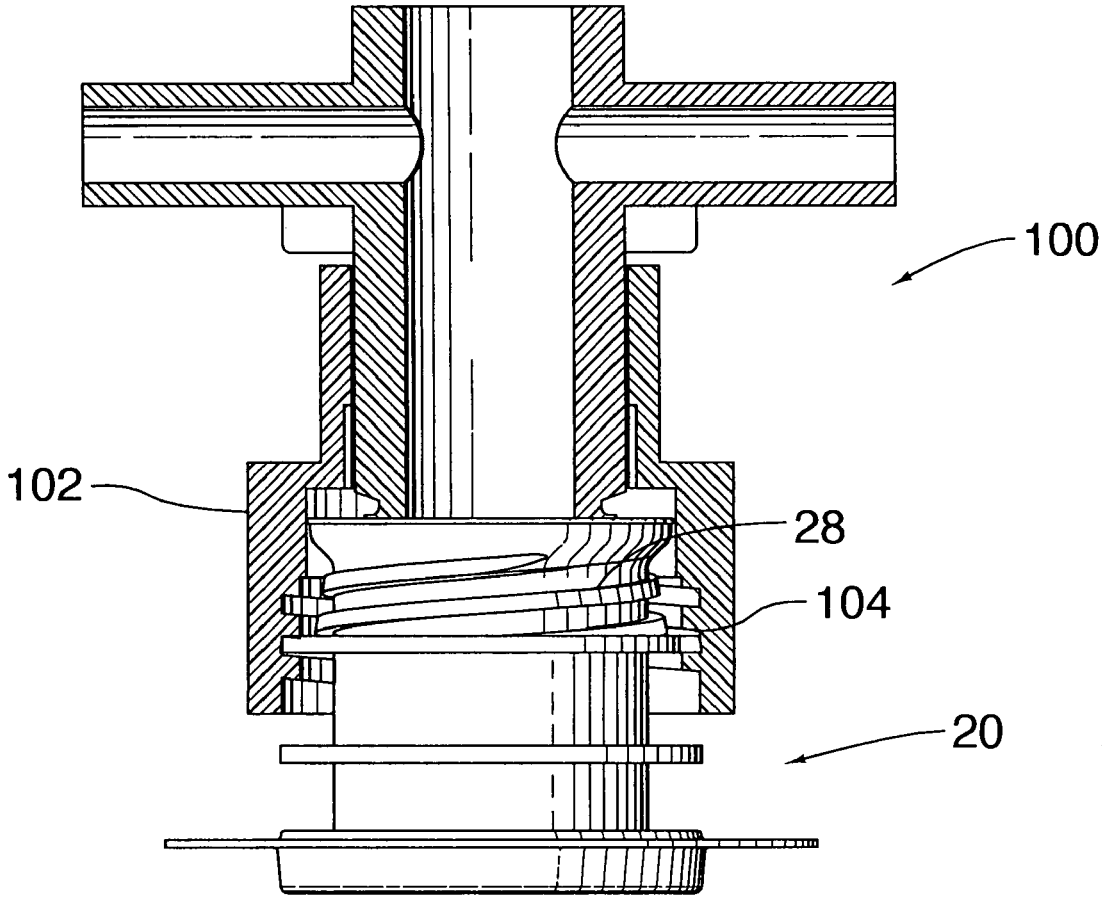
FIG. 6 is a cross-sectional view of the threaded spout of FIG. 1 connected to a dispensing connector.

The external surface 24 of the spout 20 includes threaded connecting means 28 for connecting with the internal surface of a dispensing connector 100 (See FIGS. 5 and 6). In one embodiment the threaded connecting means 28 comprises two opposing threads (28*a* and 28*b*) (See FIG. 2*b*) which are adapted to mate with corresponding threads on an internal surface of a collar of a dispensing connector to which the spout 20 of the present invention may be connected. Alternatively the thread arrangement is such that a clamp connector may be secured to the threaded arrangement 28. The lower portions of the opposing threads are located on either side of the spout 20, extend around the external surface 24 of the body 22, and extend into a first external flange at an area generally indicated at 38 in FIG. 2*b*. The opposing threads 28*a*, 28*b*, are preferably of equal geometries, for example size and configuration. The opposing threads 28*a*, 28*b* are arranged generally to allow for a greater lead-in to the threads on the internal surface of the collar of the corresponding dispensing connector 100 to which the spout 20 is to be connected. This lead-in substantially reduces the occurrence of cross threading that is known to occur with spouts used in the art such as spout configurations with tabs. The thread pitch and angle are selected to cooperate with the opposing threads to ensure positive engagement every time. The lower portion of the threads are preferably tapered. The tapering of the lower portion of the threads enables a user to ensure sufficient tightening of the spout 20 to the connector 100.

As discussed above, the design of the spout 20 including the opposing threads substantially reduces the cross-threading that can occur when known spouts used in the art are connected to different types of dispensing connectors.

Figure 2:
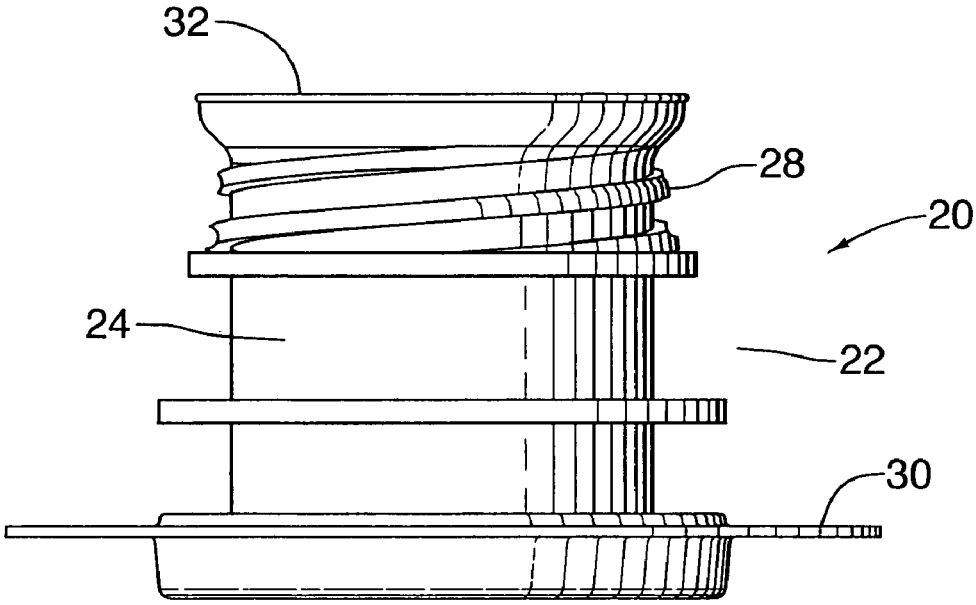
FIG. 2 is a partial section of the threaded spout of FIG. 1.
Figure 3:
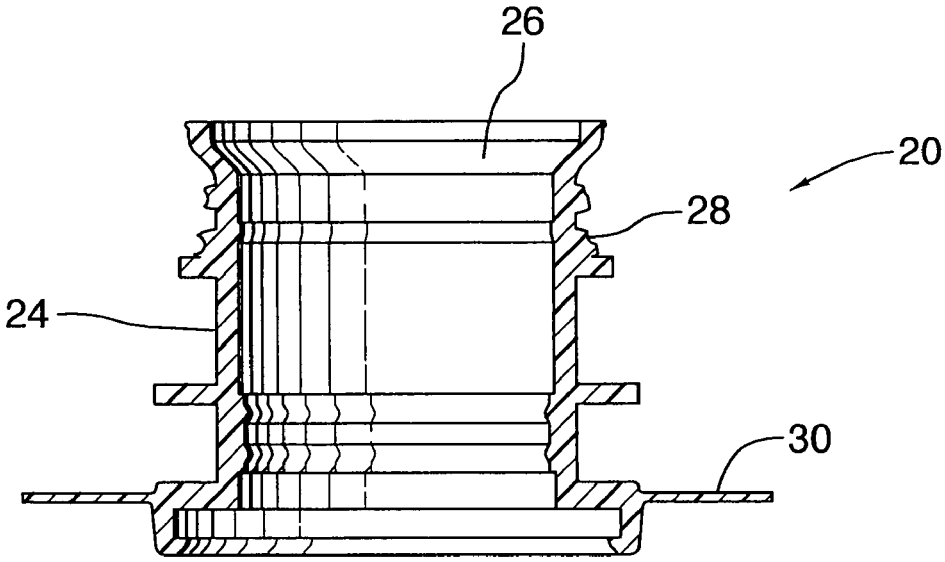
FIG. 3 is a vertical cross-sectional view of the threaded spout of FIG. 1.
Figure 4:
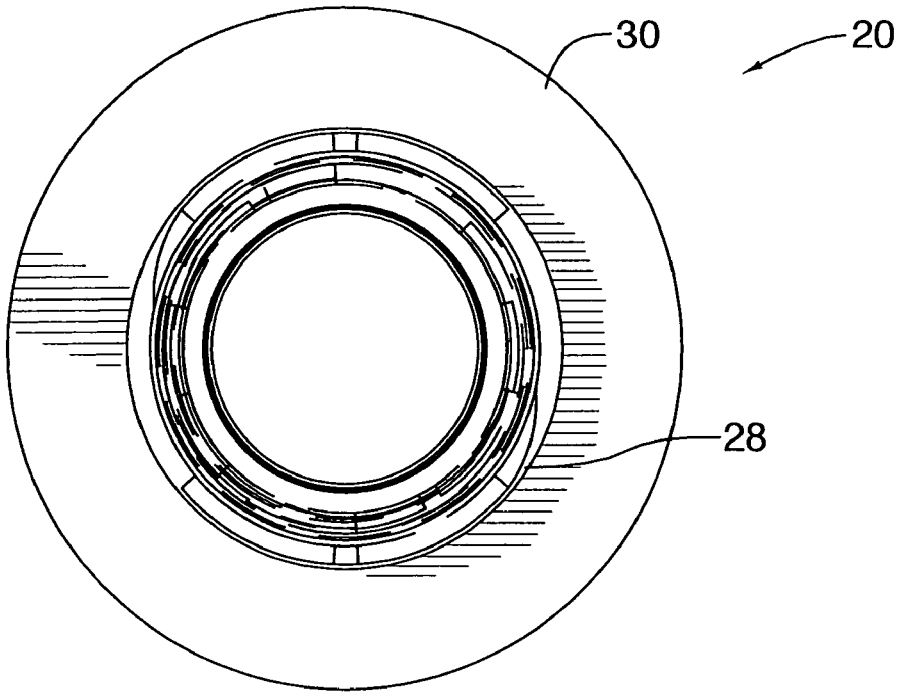
FIG. 4 is top plan view of the threaded spout of FIG. 1.

As seen in FIGS. 1-3 the external surface 24 also includes the first external flange 34 and a second external flange 36. The second external flange 36 may also include at least two wings (not shown) extending outwardly therefrom and described further below. Both the first external flange 34 and the second external flange 36 are operable to mate with different dispensing connectors.

It will be understood by a person skilled in the art that additional attachment means may be used on the external surface 24 of the spout 20 to connect it to various dispensing apparatus with which it is to be used. Examples of such attachment means can be found in Applicant's co-pending U.S. Provisional Application No. 60/458,077, illustrated in FIGS. 8-10. For example, a flange may be used that cooperates with a mounting frame of one type of dispensing connector. Alternatively a pair of wings may be attached to at least one flange located on the external surface that will cooperate with an external frame of a different type of dispensing apparatus. An example of such wings is described in further detail in U.S. application Ser. No. 10/076,572 (Davis et al.) the disclosure of which is herein incorporated by reference in its entirety.

The use of spout 20 with a dispensing connector 100 will now be described with reference to FIGS. 5 and 6. FIG. 5 illustrates the initial position of one type of dispensing connector 100 having a threaded collar 102. The threaded collar 102, having internal threads 104 is positioned to engage the threaded connecting means 28 on the external surface 24 of the spout 20. The probe 108 of the dispensing connector 100 is sized to fit in sealing engagement within the body of the spout 20. FIG. 6 illustrates the position of the dispensing connector 100 when threadingly engaged with the spout 20. As can be seen the threading engagement of the threaded collar 102 with the threaded connecting means 28 provides an accurate and tight fitting connection.

It will be understood by a person skilled in the art that the spout 20 may be used with different fitments (not shown) and various dispensing connectors. Examples of fitments and additional dispensing connectors with which the spout 20 may be used include, but are not limited to, those illustrated in co-pending U.S. Provisional Application 60/458,077. Other examples of dispensing connectors to which the spout 20 may be connected include the DuPont Liquid Packaging Systems QCD II and QCD 2 (known in the trade as the QCD fitments) as well as the Rapak PCS-1, a clamp-type connector. It will be understood by a person skilled in the art that the spout 20 may be used to connect to a dispensing connector that does not include a threaded collar.

The spout 20 of the present invention may be made from any suitable material known by persons skilled in the art. For example, the spout 20 may be made from any suitable plastic, in particular any plastic suitable for injection molding, which will be known by a person skilled in the art. Examples include, but are not limited to, linear low density polyethylene and polypropylene.

Although the invention has been described in terms of a particular preferred embodiment thereof, the skilled practitioner will understand that the external surface can include additional configurations needed to accept and mount a dispensing connector. Appropriate flanges, grooves, threads, or the like can be formed on the external surface 24 of the spout 20 as required to contact mating elements on a dispensing connector. The spout 20 may be used in combination with several fitments, for example a fitment that has an internal adapter sleeve that may have a plurality of different internal diameters in different axial regions of the sleeve in order to accommodate a plurality of different dispensing connectors.

The invention claimed is:

1. A threaded spout for use on a collapsible bag for dispensing of liquids and semi-liquids from the bag, the spout comprising a hollow cylindrical body having an external surface for mating with a collar of a dispensing connector, the external surface includes:

(a) a threaded portion which comprises two opposing threads of equal geometries for mating with an internal surface of the collar of the dispensing connector, wherein the opposing threads are spaced from each other on the external surface to provide a lead-in to the internal surface of the collar of the dispensing connector and the opposing threads extend from and form part of an upper external flange located on the external surface of the spout, and (b) a second external flange located beneath and spaced from the upper external flange and towards a base portion of the spout, a lower portion of the threads being located on either side of the spout, extending around the external surface of the spout, and extending into the upper flange on the external surface, wherein each thread has a lower end which is tapered, the spout having at one end thereof the base portion for securing the spout to the collapsible bag.

2. A threaded spout as claimed in claim 1, wherein the internal surface of the collar is cooperatively screw threaded for securing the dispensing connector thereto.

3. A threaded spout as claimed in claim 1, wherein the internal surface of the collar is adapted to clamp around the opposing threads of the dispensing connector to secure the dispensing connector thereto.

* * * * *

UNITED STATES PATENT AND TRADEMARK OFFICE

CERTIFICATE OF CORRECTION

PATENT NO. : 7,628,299 B2
APPLICATION NO. : 11/051073
DATED : December 8, 2009
INVENTOR(S) : James Johnson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 886 days.

Signed and Sealed this

Second Day of November, 2010

David J. Kappos

David J. Kappos
*Director of the United States Patent and Trademark Office*